US005651640A

United States Patent [19]

Huete et al.

[11] Patent Number: 5,651,640

[45] Date of Patent: Jul. 29, 1997

[54] COMPLAINT PLATFORM WITH PARASITE MOORING THROUGH AUXILIARY VESSEL

[75] Inventors: David Armstrong Huete, Spring; Paul Richard Johnson, Houston, both of Tex.

[73] Assignee: Shell Oil Company, Houston, Tex.

[21] Appl. No.: 24,582

[22] Filed: Mar. 1, 1993

[51] Int. Cl.[6] ..... E02B 17/00

[52] U.S. Cl. ..... 405/223.1; 166/350; 166/359; 405/195.1; 405/224

[58] Field of Search ..... 405/223.1, 224, 405/195.1; 175/7; 166/353, 354, 366, 367, 350, 359; 114/264, 266, 258, 230

[56] References Cited

U.S. PATENT DOCUMENTS

| | | | |
|---|---|---|---|
| 3,111,692 | 11/1963 | Cox | 9/8 |
| 3,255,627 | 6/1966 | Doig et al. | 175/7 X |
| 3,430,601 | 3/1969 | Thompson . | |
| 3,504,740 | 4/1970 | Manning . | |
| 3,645,225 | 2/1972 | Lunde . | |
| 3,717,002 | 2/1973 | O'Brien et al. . | |
| 3,727,414 | 4/1973 | Davies . | |
| 3,798,916 | 3/1974 | Schwemmer | 61/48 |
| 3,890,916 | 6/1975 | Tümmers et al. | 114/219 |
| 4,066,030 | 1/1978 | Milone . | |
| 4,156,577 | 5/1979 | McMakin . | |
| 4,185,694 | 1/1980 | Horton | 166/350 |
| 4,492,270 | 1/1985 | Horton . | |
| 4,494,738 | 1/1985 | Britton et al. | 267/140 |
| 4,497,593 | 2/1985 | Kramer | 405/212 |
| 4,633,953 | 1/1987 | LeBoeuf et al. . | |
| 4,643,614 | 2/1987 | Laursen . | |
| 4,694,771 | 9/1987 | Poldervaart et al. | 114/230 |
| 4,721,412 | 1/1988 | King et al. . | |
| 4,735,526 | 4/1988 | Kawagoe et al. . | |
| 4,740,109 | 4/1988 | Horton . | |
| 4,754,817 | 7/1988 | Goldsmith . | |
| 4,784,529 | 11/1988 | Hunter . | |
| 4,793,737 | 12/1988 | Shotbolt | 166/367 X |
| 4,893,965 | 1/1990 | Jordan . | |
| 4,907,657 | 3/1990 | Cox . | |

(List continued on next page.)

FOREIGN PATENT DOCUMENTS

| | | |
|---|---|---|
| 499859 | 3/1951 | Belgium . |
| WO85/01927 | 5/1985 | WIPO . |

OTHER PUBLICATIONS

"Conoco Readies Jolliet TLWP for Nov. 1 Startup," *Ocean Industry*, pp. 17–21 (Oct. 1989).

H. I. Knecht and M. E. Nagel, "Field Experience Proves Semisubmersible Drilling Tender Concept," *Offshore*, pp. 56–57 (Sep. 1990).

Kerckhoff et al., "Minifloater: A Deepwater Production Alternative," *Ocean Industry*, pp. 147–152 (Sep. 1990).

Chitwood et al., "Semisubmersible Drilling Tender Unit," *SPE Drilling Engineering*, pp. 104–110 (Jun. 1987).

*Primary Examiner*—Dennis L. Taylor
*Attorney, Agent, or Firm*—Mark A. Smith

[57] ABSTRACT

A parasite mooring system is disclosed for restraining a compliant platform with respect to an auxiliary vessel. The parasite mooring system includes a parasite mooring line, a platform termination securing the parasite mooring line to the compliant platform; and a grip securing the parasite mooring line to a mooring line of the auxiliary vessel passing beyond the compliant platform. Another aspect of the present invention is a method for conducting offshore well operations in which a semisubmersible vessel is brought adjacent a compliant platform such that at least one mooring line of the semisubmersible vessel extends past the compliant platform and a parasite mooring line from the compliant platform is connected to the mooring line of the semisubmersible vessel. The parasite mooring line can then be tensioned to displace and restrain the compliant platform out of its normal position substantially over a well pattern and position the semisubmersible vessel over a selected well site within the well pattern at a location at the surface of the water which is not accessible to the semisubmersible vessel with the compliant platform in its normal position.

22 Claims, 5 Drawing Sheets

U.S. PATENT DOCUMENTS 4,907,912 3/1990 Smith .
4,907,996 3/1990 Poldervaart ..... 114/230 X
4,913,238 4/1990 Danazcko et al. .
4,934,871 6/1990 Kazokas, Jr. .
4,966,495 10/1990 Goldman .
4,972,907 11/1990 Sellars, Jr. .
4,973,198 11/1990 Cox .
4,995,762 2/1991 Goldman .
5,159,891 11/1992 Lohr et al. ..... 114/230
5,190,411 3/1993 Huete et al. .
5,195,848 3/1993 Huete et al. .
5,199,821 4/1993 Huete et al. .
5,207,534 5/1993 Brasted et al. .

40
42
40A
48
60A
30
10A
10
26
24
118
12
22
50
50
20
54
52A
52
60
52
46
16
28
44
44A
14
44

FIG. 1A
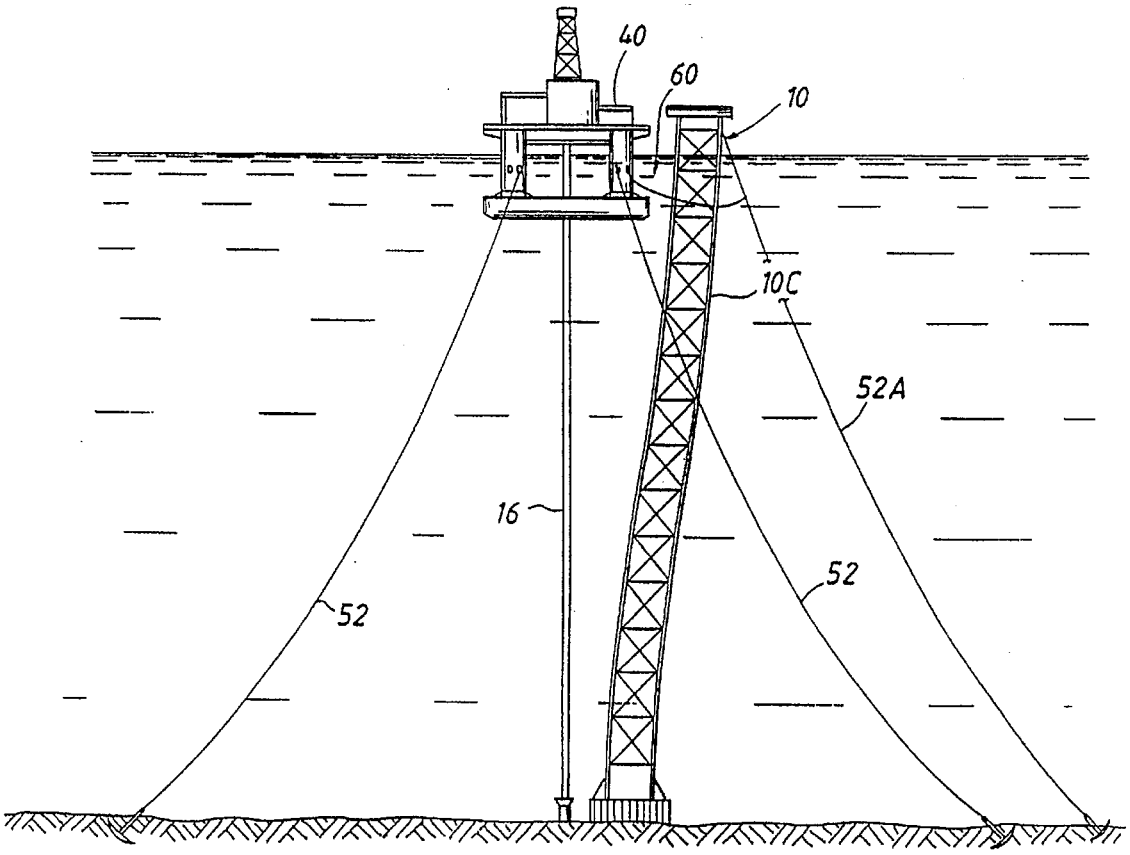
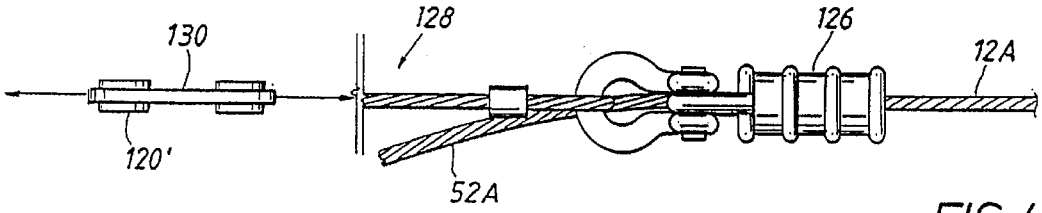
FIG. 4A
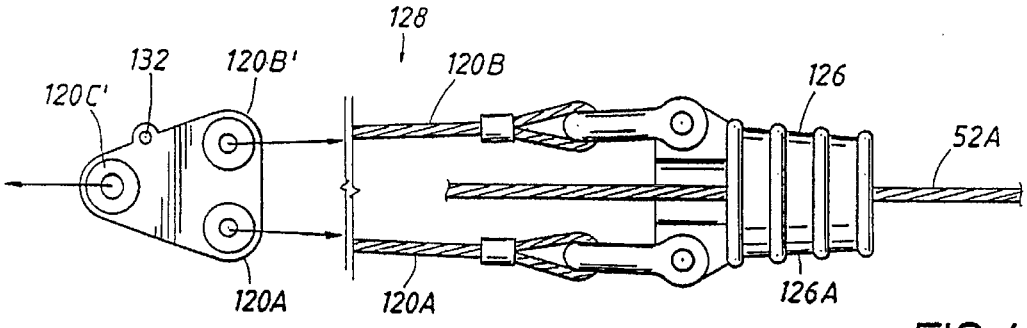
FIG. 4B

FIG. 2
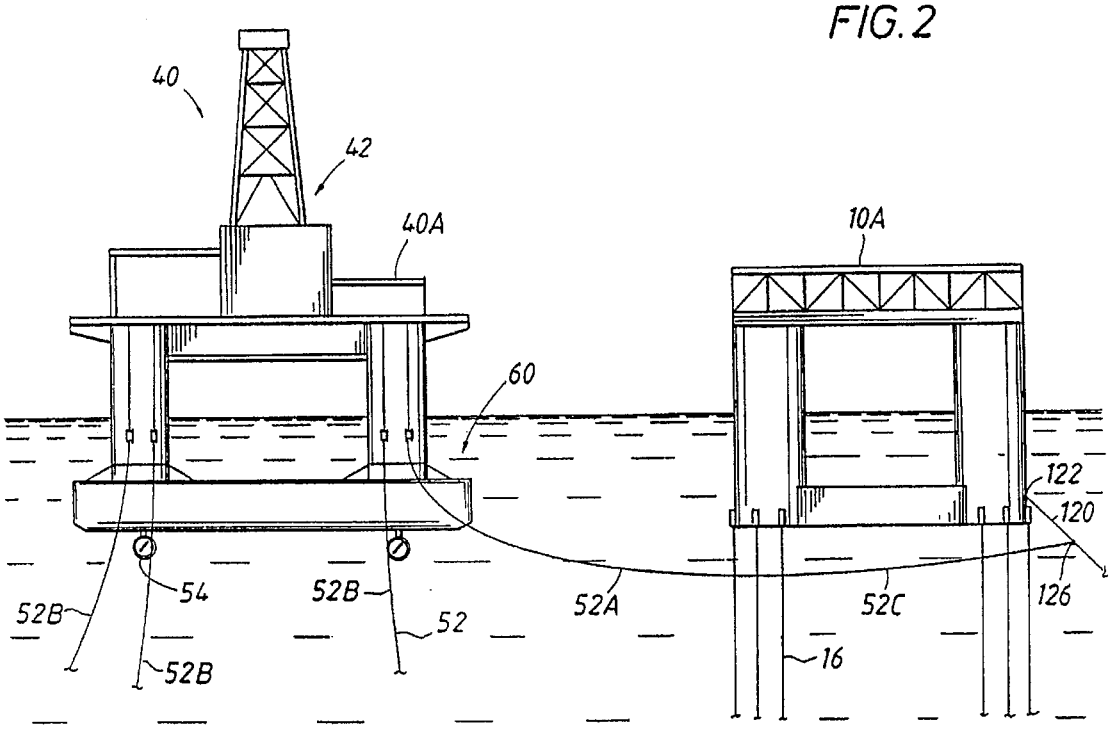
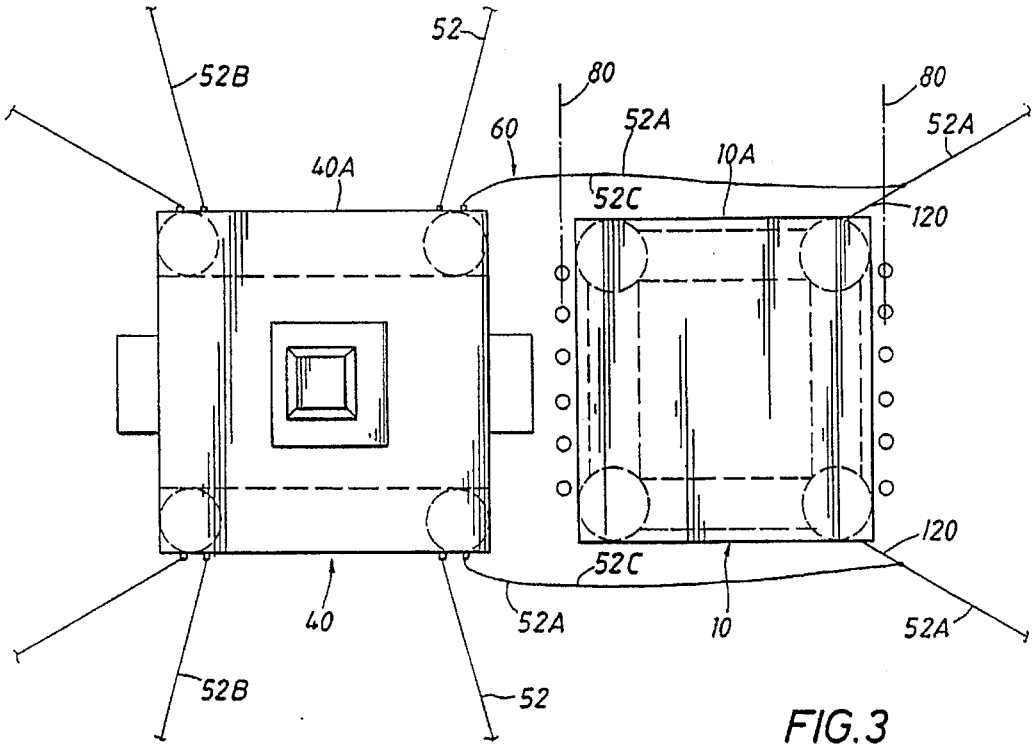
FIG. 3

FIG. 6
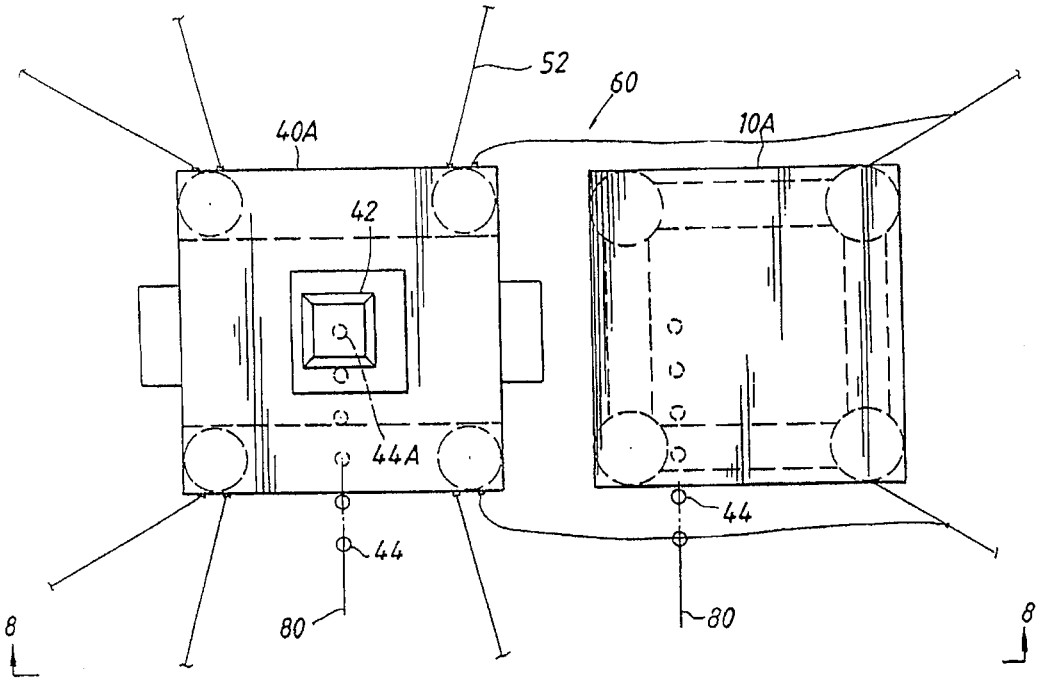
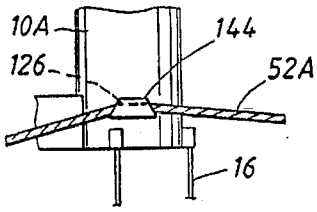
FIG. 5C
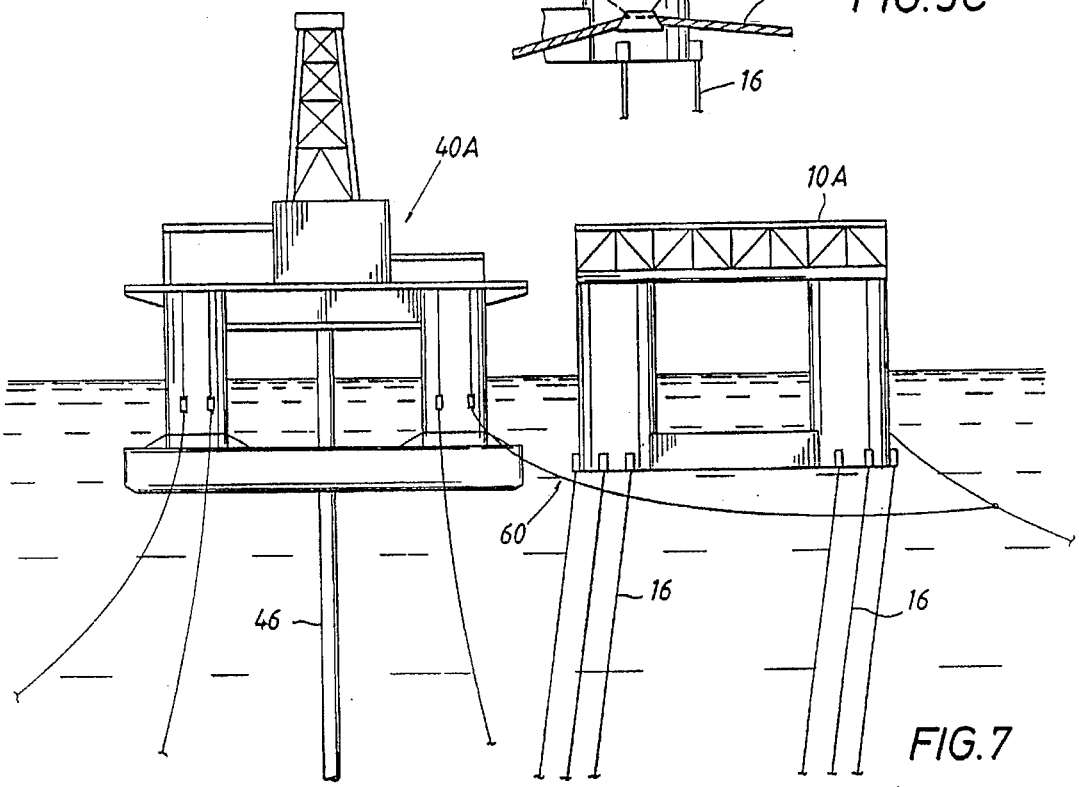
FIG. 7

COMPLAINT PLATFORM WITH PARASITE MOORING THROUGH AUXILIARY VESSEL

BACKGROUND OF THE INVENTION

The present invention relates to a method for conducting well operations for offshore reservoirs. More particularly, the present invention relates to a system and method for restraining an auxiliary vessel to a compliant platform in support of well operations.

Traditional bottom-founded platforms having fixed or rigid tower structures have been taken to their logical depth limits in the development of offshore oil and gas reserves. Economic considerations suggest that alternatives to this traditional technology be used in deep waters.

Alternative designs have been developed for various configurations of "compliant platforms", e.g., tension leg, compliant tower, and articulated tower platforms as well as floating production systems, which can provide drilling and production facilities in deepwater at costs less than those of traditional fixed platforms.

Further economies and benefits have been provided to the use of such compliant platforms by the recent development of a method for conducting well operations for offshore wells as disclosed in U.S. patent application Ser. No. 624, 866 filed Dec. 10, 1990, in which an offshore drilling vessel is docked to the compliant platform which is driven out of substantially vertical alignment over the well site in order to align a drilling derrick of the offshore drilling vessel thereover. Well operations are then conducted from the drilling vessel and the production riser is transferred from the vessel to the compliant platform. This method facilitates supporting well operations with an auxiliary vessel for surface accessible completions which are then hung on a deepwater compliant platform. This permits the use of a compliant platform which does not have to be scaled to accommodate the weight of a major drilling rig and permits well operation facilities supplied by the auxiliary vessel to relocate when those facilities are not needed at the platform.

However, the auxiliary vessel and the compliant platform respond to environmental loads from wind, wave, and current unequally and out of phase. Traditional docking methods will tend to transmit vertical loads from the auxiliary vessel to the compliant platform as the docking elements resist relative motion therebetween. Increasing the capacity of the compliant platform to accommodate such temporary load conditions works against some of the principle benefits of this method of conducting well operations.

Thus, there is a need for a restraining or docking system that better facilitates the use of auxiliary vessels in support of well operations for compliant platforms.

SUMMARY OF THE INVENTION

Toward the fulfillment of this need, the present invention is a parasite mooring system for restraining a compliant platform with respect to an auxiliary vessel having a mooring line which is anchored in a spread that extends beyond the compliant platform. A parasite mooring system operatively connects a donor mooring line from the auxiliary vessel to the compliant platform. Slack is maintained in the donor mooring line between the auxiliary vessel and the compliant platform while the anchor end of the donor mooring line is pulled taut to restrain the compliant platform with respect to the sea floor.

In another embodiment, the parasite mooring system includes a parasite mooring line, a platform termination securing the parasite mooring line to the compliant platform; and a connection securing the parasite mooring line to the mooring line of the auxiliary vessel.

Another aspect of the present invention is a method for conducting offshore well operations in which a semisubmersible vessel is brought adjacent a compliant platform such that at least one mooring line of the semisubmersible vessel extends past the compliant platform and a parasite mooring line from the compliant platform is connected to the mooring line of the semisubmersible vessel. The parasite mooring line can then be tensioned to displace and restrain the compliant platform out of its normal position substantially over a well pattern and position the semisubmersible vessel over a selected well site within the well pattern at a location at the surface of the water which is not accessible to the semisubmersible vessel with the compliant platform in its normal position.

BRIEF DESCRIPTION OF THE DRAWINGS

The brief description above, as well as further objects, features and advantages of the present invention will be more fully appreciated by reference to the following detailed description of the preferred embodiments which should be read in conjunction with the accompanying drawings in which:

FIG. 1A is a side elevational view of a semisubmersible vessel embodiment of the practice of the present invention in which a semisubmersible vessel is restrained with respect to a compliant tower.

FIG. 2 is a side elevation view of a semisubmersible vessel and a compliant platform which are restrained with respect to each other in accordance with the present invention.

FIG. 3 is a top plan view of a semisubmersible vessel and a compliant platform restrained with respect to each other for operations in accordance with the practice of an embodiment of the present invention.

FIG. 4A is a side elevational view of a parasite mooring line to mooring line connection.

FIG. 4B is a top elevation view of the parasite mooring line to mooring line connection of FIG. 4A.

FIG. 5C is a side elevation view of an alternate operable connection between a compliant platform and a donor mooring line.

FIG. 6 is a top plan view of a semisubmersible vessel docked to a compliant platform in accordance with the practice of an embodiment of the present invention and taking position for drilling operations over a selected well site.

FIG. 7 is a side elevation view of a semisubmersible vessel docked with a compliant platform in accordance with the practice of an embodiment of the present invention and conducting drilling operations.

DETAILED DESCRIPTION OF PREFERRED EMBODIMENTS

Figure 1:
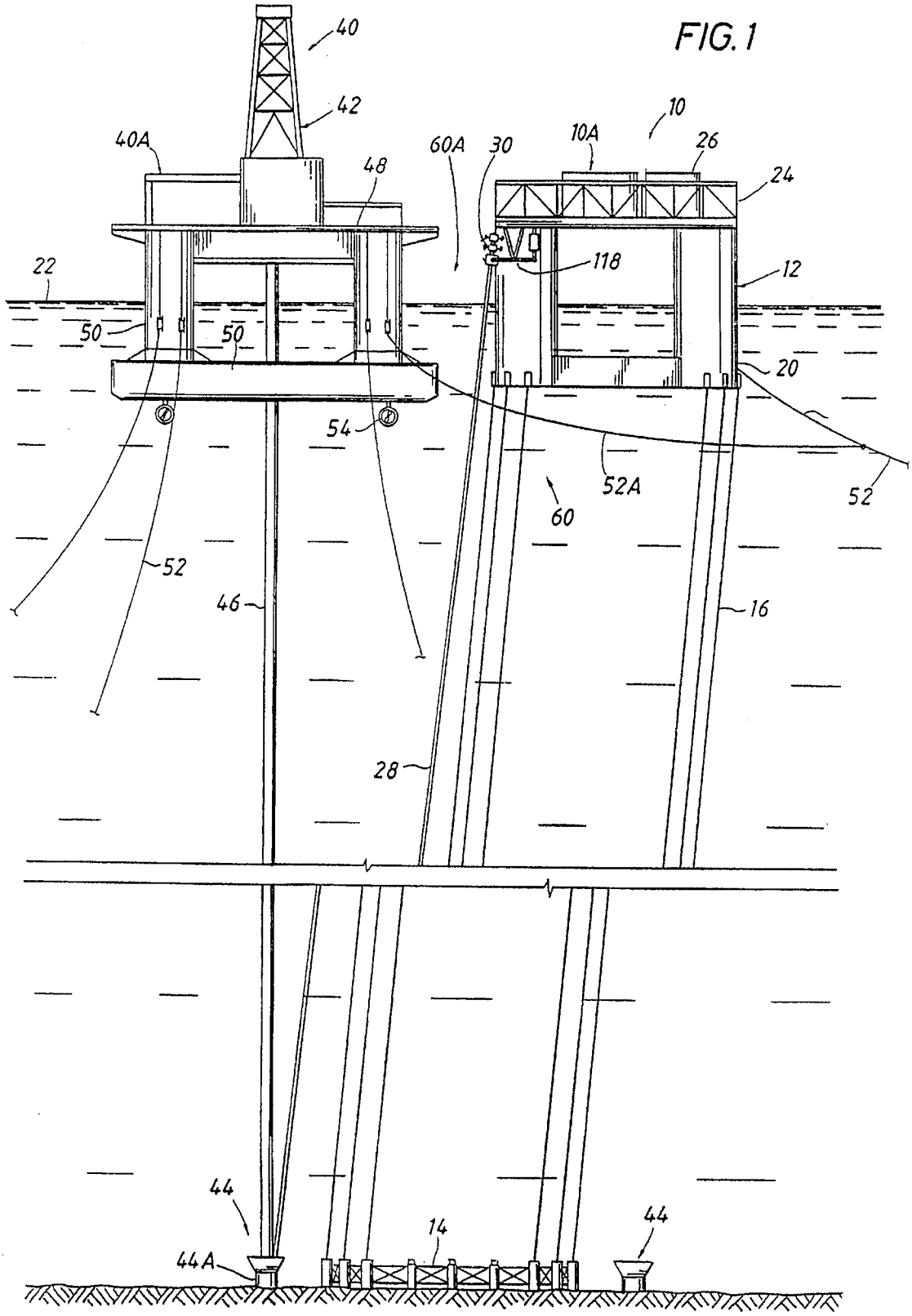
FIG. 1 is a side elevation view of a semisubmersible vessel restrained with respect to a tension leg well jacket ("TLWJ") in accordance with the present invention.

FIG. 1 is a side elevation view of a restraint system and operations practiced in accordance with the present invention with compliant platform 10 docked to offshore drilling vessel 40, here a semisubmersible vessel 40A.

In this illustration, compliant platform 10 is provided by a tension leg well jacket ("TLWJ") 10A which has a floating superstructure 12 secured to a foundation 14 with a plurality of tendons or tension legs 16 which draw buoyant hull 20 of superstructure 12 below its free-floating draft at ocean surface 22. Hull 20 supports a deck 24 which carries processing facilities 26.

Semisubmersible vessel 40A is illustrated conducting drilling operations with derrick and related drilling facilities 42 supported on deck 48 which is in turn supported by pontoons, columns or other buoyant members 50. The derrick of the semisubmersible vessel is positioned over one of the well sites 44, here at well site 44A, using a catenary mooring system 52 or dynamic positioning thrusters 54 and drilling operations are conducted through a drilling riser 46. A production riser 28 of a previously drilled well is supported by tension leg well jacket 10A with the valve assembly of the surface completion or Christmas tree 30 supported above the ocean's surface in a tensioning system 118.

Offshore drilling vessel 40 interfaces with compliant platform 10 through a restraining system 60, here provided by parasite mooring system 60A.

Alternate forms of compliant platforms can be adapted for use in the practice of the present invention and FIG. 1A illustrates an alternate embodiment of the practice of the present invention in which compliant platform 10 is provided by a compliant tower 10C which is assisted by drilling from offshore drilling vessel 40.

The present invention facilitates conducting well operations for a compliant platform from an auxiliary vessel. A "compliant" platform is any offshore surface facility designed to "give" in a controlled manner with environmental loading rather than rigidly resist such force. This basic design precept distinguishes the fixed or rigid bottom-founded towers which require vast amounts of structural materials for extension into deep water. Many basic configurations of compliant platforms have been proposed including articulated towers, compliant towers, compliant piled towers, tension leg platforms, etc., a sampling of which are illustrated in the FIG. 1 series discussed above. However, any basic configuration which is compliant, favorably economically sensitive to load reductions, and adaptable to receive support from an auxiliary vessel is well suited for use in the practice of the present invention. FIGS. 2 through 8 illustrate the practice of the present invention in support of a tension leg well jacket which is a minimal tension leg platform without drilling capabilities, and, at most, modest completion or workover capabilities. However, those skilled in the art and familiar with the teachings of this application could apply this practice to any other basic compliant platform configuration.

FIG. 2 illustrates deployment of offshore drilling vessel 40 adjacent installed tension leg well jacket 10A. The offshore drilling vessel is a floating structure which carries a derrick, drawworks and related drilling facilities 42. Further, the term "offshore drilling vessel" is intended to cover any transportable, floating facilities of an auxiliary vessel capable of supporting well operations such as drilling, completion, workover, well repair or abandonment. Preferably, these facilities are provided in a substantially open design adapted for stability in deepwater drilling applications. Semisubmersible vessels represent a class of vessels well suited to this application and have been used throughout to generally illustrate the practice of the present invention.

Semisubmersible vessel 40A in FIG. 2 is provided with catenary mooring lines 52. In the practice of the present invention, the catenary mooring lines are deployed and anchored in a spread about the semisubmersible vessel which overlaps the position of the tension leg well jacket, passing some of the mooring lines, here donor mooring lines 52A, adjacent tension leg well jacket 10A. Semisubmersible vessel 40A can then be maneuvered with respect to tension leg well jacket 10A by playing out and retrieving selected catenary mooring lines 52, here primary positioning mooring lines 52B. Alternatively, the semisubmersible vessel may be maneuvered with thrusters 54.

Parasite mooring system 60A includes a parasite mooring line 120 which is connected to tension leg well jacket 10A through a platform termination 122 on one end and to donor mooring lines 52A provided by semisubmersible vessel 40A on the other end through grip 126. Environmental loads on semisubmersible 40A are effectively decoupled from the tension leg well jacket by maintaining a clearance between the semisubmersible and the tension leg well jacket and establishing and maintaining a region of relative slack 52C in donor mooring line 52A between the semisubmersible vessel and grip 126.

In one practice of the present invention, the parasite mooring system is deployed in hookup operations which are preceded by anchoring the semisubmersible vessel and preloading each of its mooring lines 52. A work boat chases down a first donor mooring line 52A adjacent the tension leg well jacket to a predetermined position, e.g. several hundred feet, beyond the tension leg well jacket. The donor mooring line is slackened from the semisubmersible vessel and is pulled aboard the work boat and a friction set grip 126 is attached. See FIGS. 4A and 4B.

In the illustrated embodiment, the grip is provided by a Lucker style friction set grip 126A which attaches to donor mooring line 52A. The parasite mooring line 120 is connected to grip 126A through a shackle and triplate assembly 128. Triplate 130 receives pins to attach shackled lines 120A and 120B at pin holes 120A' and 120B' and passes to a single line for the remainder of parasite mooring line 120 through a shackled connection at pin hole 120C'. It may further be desired to supply a connection 132 on triplate 130 to receive a handling line or buoy support.

In this embodiment, the operable connection of the donor mooring line to the compliant platform is completed through a winch, such as linear winch 134 mounted on the tension leg well jacket 10A. See FIG. 5A. Parasite mooring line 120 is brought around a tight radius bend at chock 136 near the base of the tension leg well jacket keel, through linear winch 120, and the slack is stored in a locker or holding bin 138. The linear winch is temporarily mounted on support 140 to facilitate hookup, biasing and release operations.

After friction set grip 126 is installed forming an intermediate connection securing parasite mooring line 120 to donor mooring lines 52A, the grips and triplate assembles are released from the work boat. It is preferred that this procedure be repeated for operably connecting a plurality of parasite mooring lines to corresponding donor mooring lines. The parasite mooring lines are then taken in at linear winches 134, bringing the parasite mooring lines into the load path to the anchors of the donor mooring lines and ultimately biasing the tension leg well jacket aside while slack 52C is maintained between the auxiliary vessel and the intermediate connection with the grip. See also FIG. 2.

The present restraint system facilitates moving tension leg well jacket 10A with positioning systems carried on semisubmersible vessel 40A. Compare FIG. 3 in which tension leg well jacket 10A is normally centered between well lines 80 at the periphery of the tension leg well jacket with FIG. 6 wherein the catenary mooring lines 52 have been adjusted to bias tension leg well jacket 10A out of alignment with its nominal position and to bring the derrick and related drilling facilities 42 into alignment with a selected well site 44A. The semisubmersible vessel of FIG. 6 is in position to initiate drilling or other well operations through a drilling riser 46 as further illustrated in FIG. 7. Use of a cantilevered deck, end bay semisubmersible vessel would better maximize the clearance with respect to the tension leg well jacket. The drilling operations are best undertaken in substantially vertical drilling risers and the ability to shift compliant platform 10 slightly out of alignment with its nominal resting position in order to place the derrick over a selected well site substantially enhances drilling efficiency and reduces equipment wear. This ability also allows continuing drilling operations once the tension leg well jacket is in place and thereby allows production to come onstream as soon as wells are completed, even as the drilling program proceeds.

After drilling or other well operations are performed, it is preferred practice that drilling riser 46 is replaced with a lighter weight production riser 28 and the drilling facilities on offshore drilling vessel 40 are used through the production riser to complete the well. After completion of the well and installation of a surface christmas tree 30, a temporary buoyancy module 110 is installed about the production riser and the production riser is passed or transferred to compliant platform 10, here tension leg well jacket 10A. See FIG. 8. Alternatively, a temporary, modest workover rig may be installed on tension leg well jacket 10A and used to install the production riser and complete the well.

Guylines 112 are used to draw production riser 28 to tension leg well jacket 10A. Alternatively, the natural righting ability of temporary buoyancy module 110 is used to maintain production riser 28 in place while catenary mooring lines 52 are adjusted to bring tension leg well jacket 10A into position to receive the substantially stationary production riser 28. The presently preferred method for undertaking this transfer is a combination of both the methods.

Copending U.S. patent application Ser. No. 919,630 filed Jul. 24, 1992, which is a continuation of application Ser. No. 624,866 filed Dec. 10, 1990, by D. A. Huete et al, for a Method for Conducting Offshore Well Operations is hereby incorporated by reference and made a part hereof. That application provides further details of the general use and benefits of the method of conducting well operations facilitated by the present invention.

Normal release procedures at the conclusion of well operations reverse those discussed above for setting up. However, storm and hurricane conditions may require other release procedures or adjustments. Severe storm conditions may dictate cessation of drilling operations and backing the semisubmersible away to increase clearance in the event the donor mooring lines drag their respective anchors. Further, emergency hurricane response may dictate moving and securely anchoring the semisubmersible vessel well clear of the tension leg well jacket's normal, vertical position and then severing or releasing the parasite mooring lines to most quickly return the tension leg well jacket to its normal position. The loose ends of the parasite mooring lines are left attached to the donor mooring lines during the storm and retrieved thereafter for re-deployment or replacement.

Figure 5A:
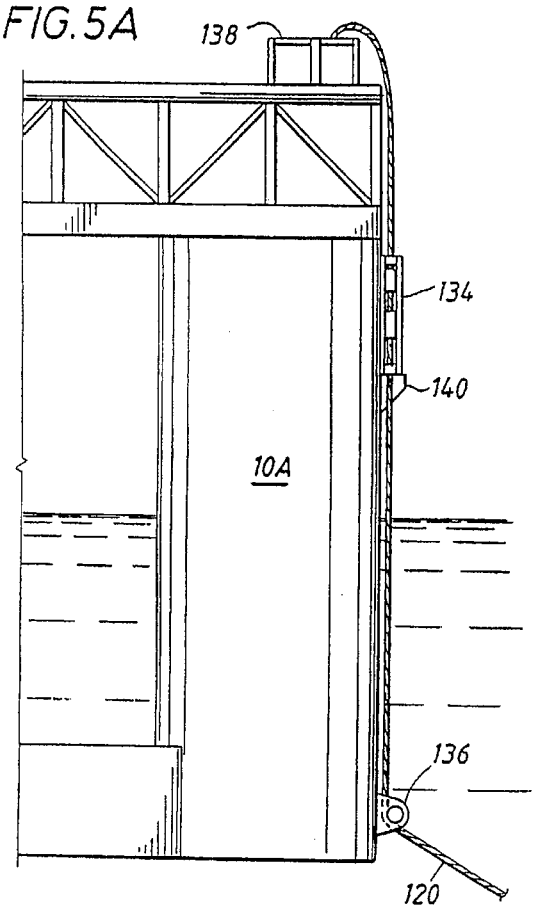
FIG. 5A is a side elevation view of a connection of a parasite mooring line to a compliant platform.
Figure 5B:
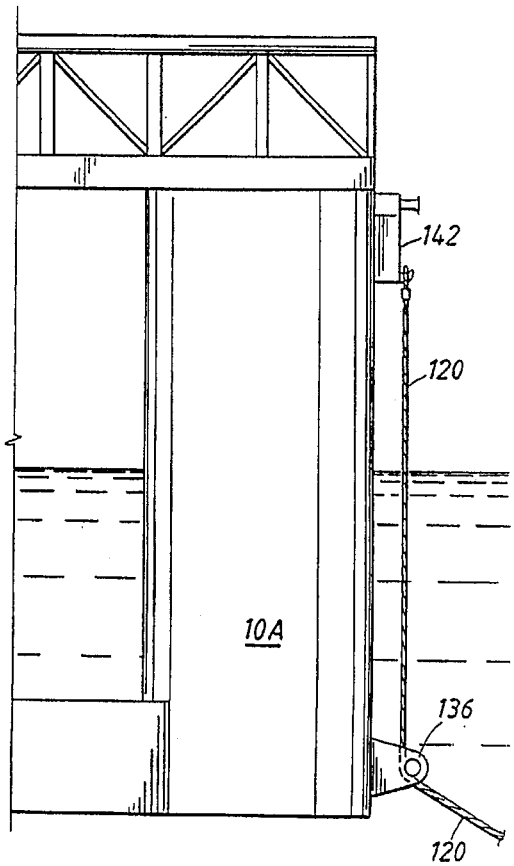
FIG. 5B is a side elevation view of an alternate connection between a parasite mooring line and a compliant platform.
Figure 8:
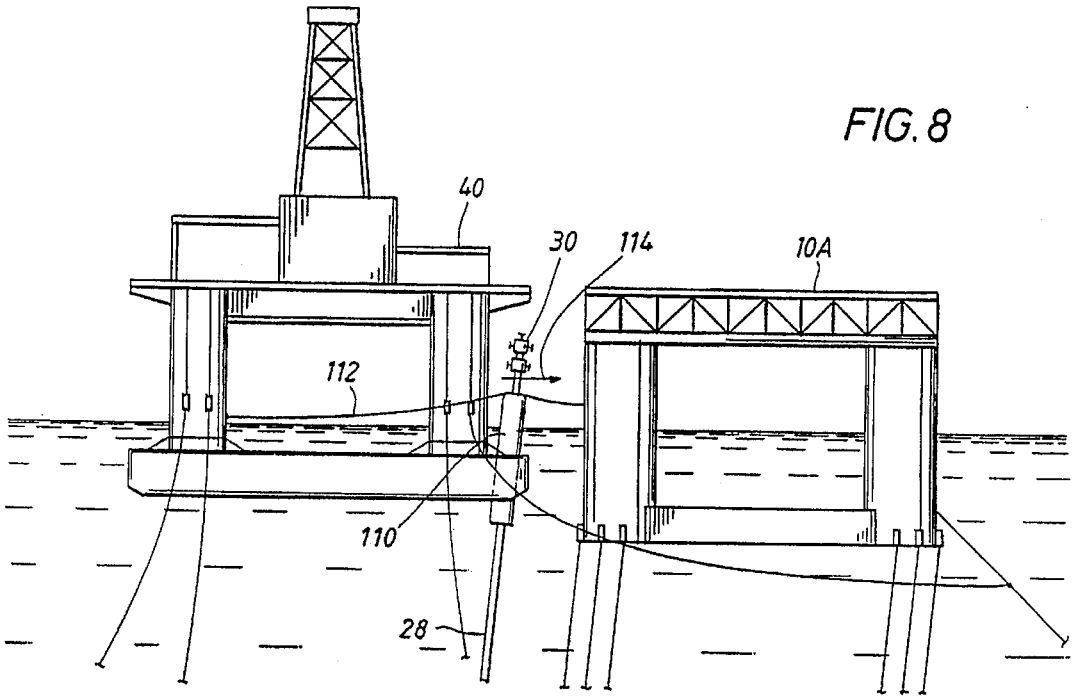
FIG. 8 is a side elevation view of a semisubmersible platform transferring a riser to a compliant platform which is docked thereto in accordance with a practice of the present invention.

Alternatively, the compliant platform may be otherwise biased aside, e.g. pushed by the semisubmersible vessel, then secured from this position with a non-winching termination such as a mechanized pelican hook 142 as illustrated in FIG. 5B. In this embodiment, it is preferred to provide some bumper or sliding interface between the auxiliary vessel and the compliant platform if direct contact is used to push the compliant platform aside. Once the compliant platform is in place, the restraining force is supplied by the donor mooring line and the auxiliary vessel is backed off to provide suitable clearance. Note also that the pelican hook termination provides for easy release in hurricane preparation.

Another practice of this invention receives the donor mooring lines in friction set grips 126 set within troughs 144 mounted directly to the tension leg well jacket 10A adjacent the keel. See FIG. 5C. The donor mooring lines may be placed to slide within the troughs when the platform is being moved by direct contact from the auxiliary vessel, with the grips set to secure the donor mooring lines 52A in an operable connection to secure a desired position.

A number of variations have been disclosed for docking systems and techniques for joining offshore vessel and structures in a manner which isolates each from the transmission of vertical loads from the other. As noted above, this docking system and technique are uniquely suited to, but in its broadest elements not limited to, providing temporary facilities of an offshore vessel to a tension leg well jacket for conducting well operations. Other modifications, changes and substitutions are intended in the foregoing disclosure. Further, in some instances, some features of the present invention will be employed without a corresponding use of other features described in these preferred embodiments. Accordingly, it is appropriate that the appended claims be construed broadly and in a manner consistent with the spirit and scope of the invention herein.

What is claimed is:

1. A parasite meeting system for restraining a compliant platform with respect to an auxiliary vessel, comprising:

a donor mooring line which is played out from the auxiliary vessel and anchored to an ocean floor at a location beyond the compliant platform;

an operable connection securing the donor mooring line of the auxiliary vessel to the compliant platform, said operable connection permitting tensioning upon the donor mooring line to shift the position of the compliant platform; and whereby the compliant platform is temporarily restrained out of its normal alignment with respect to the ocean floor through the donor mooring line.

2. A parasite mooring line in accordance with claim 1 wherein the operable connection comprises:

a parasite mooring line;

a platform termination securing the parasite mooring line to the compliant platform in a manner that permits playing in and playing out the parasite mooring line; and an intermediate connection securing the parasite mooring line to the donor mooring line of the auxiliary vessel.

3. A parasite mooring line in accordance with claim 1 wherein the operable connection comprises:

a trough mounted to the compliant platform; and a friction-set grip mounted within the trough to receive the donor mooring line.

4. A parasite mooring system for restraining a compliant platform with respect to an auxiliary vessel having a mooring line which is anchored to an ocean floor at a location beyond the compliant platform, said parasite mooring system comprising:

a parasite mooring line;

a platform termination securing the parasite mooring line to the compliant platform in a manner that permits playing in and playing out the parasite mooring line; and a connection securing the parasite mooring line to the mooring line of the auxiliary vessel.

5. A parasite mooring system in accordance with claim 4 wherein a plurality of mooring lines are provided by the auxiliary vessel as donor mooring lines which are slack between the auxiliary vessel and the compliant platform, further comprising:

a plurality of the parasite mooring lines connected to the compliant platform;

a plurality of the connections, each connecting one of the parasite mooring lines to a donor mooring line provided by the auxiliary vessel; and a plurality of primary positioning mooring lines deployed by the auxiliary vessel to secure the position thereof relative to the ocean floor.

6. A parasite mooring system in accordance with claim 4 wherein the platform termination further comprises a winch for taking in and playing out the parasite mooring line.

7. A parasite mooring system in accordance with claim 6 wherein the platform termination comprises a closed chock mounted on the platform through which the parasite mooring line is threaded.

8. A parasite mooring system in accordance with claim 7 wherein the winch is a linear winch.

9. A parasite mooring system in accordance with claim 4 wherein the grip is a friction-set grip.

10. A parasite mooring system for restraining a tension leg well jacket with respect to a semisubmersible vessel having a mooring line which is anchored to an ocean floor at a location beyond the tension leg well jacket, said parasite mooring system comprising:

a parasite mooring line;

a platform termination securing the parasite mooring line to the tension leg platform in a manner that permits playing in and playing out the parasite mooring line; and a connection securing the parasite mooring line to the mooring line of the semisubmersible vessel.

11. A parasite mooring system in accordance with claim 10 wherein a plurality of mooring lines are provided by the semisubmersible vessel as donor mooring lines which are slack between the semisubmersible vessel and the tension leg well jacket, further comprising:

a plurality of the parasite mooring lines connected to the tension leg well jacket;

a plurality of the connections, each connecting one of the parasite mooring lines to a donor mooring line provided by the semisubmersible vessel; and a plurality of primary positioning mooring lines deployed by the semisubmersible vessel to secure the position thereof relative to the ocean floor.

12. A parasite mooring system in accordance with claim 10 wherein the platform termination further comprises a winch for taking in and playing out the parasite mooring line.

13. A parasite mooring system in accordance with claim 12 wherein the platform termination comprises a closed chock mounted on the tension leg well jacket through which the parasite mooring line is threaded.

14. A parasite mooring system in accordance with claim 13 wherein the winch is a linear winch.

15. A parasite mooring system in accordance with claim 10 wherein the connection is a friction-set grip.

16. A method for conducting offshore well operations, comprising:

placing an auxiliary vessel adjacent a compliant platform such that at least one donor mooring line of the auxiliary vessel extends past the compliant platform;

operably connecting the donor mooring line of the auxiliary vessel to the compliant platform;

tensioning the donor mooring line on its anchor end to displace and restrain the compliant platform out of its normal position substantially over a well pattern;

introducing slack in the donor mooring line between the auxiliary vessel and the compliant platform; and positioning the auxiliary vessel over a selected well site of the pattern at a location at the surface of the water not accessible to the auxiliary vessel with the compliant platform in its normal position.

17. A method in accordance with claim 16 wherein operably connecting the donor mooring line comprises connecting a parasite mooring line from the compliant platform to the donor mooring line of the auxiliary vessel.

18. A method for conducting offshore well operations, comprising:

placing an auxiliary vessel adjacent a compliant platform such that at least one mooring line of the auxiliary vessel extends past the compliant platform;

connecting a parasite mooring line from the compliant platform to the mooring line of the auxiliary vessel;

tensioning the parasite mooring line to displace and restrain the compliant platform out of its normal position substantially over a well pattern; and positioning the auxiliary vessel over a selected well site of the pattern at a location at the surface of the water not accessible to the auxiliary vessel with the compliant platform in its normal position.

19. A method for conducting offshore well operations, comprising:

placing a semisubmersible vessel adjacent a tension leg well jacket such that at a plurality of donor mooring lines of the semisubmersible vessel extend past the tension leg well jacket;

connecting a parasite mooring line from the tension leg well jacket to the mooring line of the semisubmersible vessel;

tensioning the parasite mooring line to displace and restrain the tension leg well jacket out of its normal position substantially over a well pattern; and positioning the semisubmersible vessel over a selected well site of the pattern at a location at the surface of the water not accessible to the semisubmersible vessel with the tension leg well jacket in its normal position.

20. A method for conducting offshore operations in accordance with claim 19 wherein positioning the semisubmersible vessel over a selected well site comprises adjusting a plurality of primary positioning mooring lines deployed by the semisubmersible vessel and anchored to the ocean floor.

21. A method for conducting offshore well operations in accordance with claim 20, further comprising:

slackening the donor mooring line between the semisubmersible vessel and the tension leg well jacket; and maintaining a clearance separating the semisubmersible vessel and the tension leg well jacket through the relative position each is anchored to the ocean floor.

22. A method for conducting offshore well operations in accordance with claim 21, wherein tensioning the parasite mooring line comprises drawing in the parasite mooring line with winches on the tension leg well jacket.

* * * * *